United States Patent [19]

Hemmi et al.

[11] 3,993,999

[45] Nov. 23, 1976

[54] AMPLITUDE MODULATION SCANNING ANTENNA SYSTEM

[75] Inventors: Christian O. Hemmi; William F. Hayes, both of Dallas, Tex.

[73] Assignee: Texas Instruments Incorporated, Dallas, Tex.

[22] Filed: May 16, 1975

[21] Appl. No.: 578,231

[52] U.S. Cl. ..... 343/854; 343/100 SA; 343/754

[51] Int. Cl.[2] ..... H01Q 3/26

[58] Field of Search ..... 343/100 SA, 754, 854

[56] References Cited

UNITED STATES PATENTS

| | | | |
|---|---|---|---|
| 3,259,902 | 7/1966 | Malech | 343/754 |
| 3,496,569 | 2/1970 | Alsberg et al. | 343/754 |
| 3,680,110 | 7/1972 | Goldstone | 343/100 SA |
| 3,775,769 | 11/1973 | Heeren et al. | 343/100 SA |
| 3,806,932 | 4/1974 | Dietrich et al. | 343/854 |
| 3,893,124 | 7/1975 | Barker | 343/854 |

*Primary Examiner*—David C. Nelms
*Attorney, Agent, or Firm*—Harold Levine; Andrew M. Hassell; Rene' E. Grossman

[57] ABSTRACT

An antenna system forming a cluster of closely spaced beams filling a desired angular scan sector is disclosed. A transmit signal amplitude applied to each beam is modulated as a function of time to form a composite beam which scans smoothly across the scan sector. The RF transmit signal is initially split into a plurality of equal amplitude signals and fed to a plurality of attenuators by power dividers for selective amplitude modulation of the RF signals. The amplitude modulating signals are supplied the attenuator by a digital controller which also supplies switch control signals to selectively switch amplitude modulating transmit signals of varying amplitude to selected feed elements of an array of radiating elements in a time sequence for feeding an antenna reflector.

13 Claims, 5 Drawing Figures

13
18
11
14
13
26
13
17
16
20
11
28
20
22
12
14
10
14
11
12

AMPLITUDE MODULATION SCANNING ANTENNA SYSTEM

This invention relates to an electronically scanned antenna system and, more particularly, to a system for forming an electronically scanning antenna beam by modulating the amplitude of excitation of an array which illuminates a reflector.

In the past the most frequently utilized approach for controlling the position of a secondary radiation beam has been to move a single feed element in front of a reflector utilized for forming the secondary beam. Another system which has been used when a plurality of steerable means are required is to use a phased array antenna system. The usual phased array includes a plurality of independent linear or planar feed elements which are simultaneously excited with energy of different phases. To scan the beam pattern, the phase shift of each element excitation is changed. For broad band applications, the phased array antenna system has included means for simultaneously deriving a plurality of steerable beams by using in combination with a secondary beam-forming reflector a primary radiation source having a plurality of feed elements. To form one primary beam, a plurality of adjacent feed elements are simultaneously phase excited to the exclusion of other feed elements through a switching matrix. Feed elements have been simultaneously excited to either transmit or receive modes with a circulator connected between first and second switching arrays, respectively, connected to at least one transmitter and receiver. Because the only connections to the transmitters and/or receivers in the radiation elements are through wideband devices such as switches, circulators and hybrids, the frequency dependent problems encountered in phased arrays are obviated and a plurality of steerable beams can be generated over a wide bandwidth. A problem with the prior art phased array antenna systems is that the beam is stepped through scanning.

Accordingly, it is an object of the invention to provide a new and improved system for electronically scanning an antenna beam which simulates a beam produced by a standard mechanically scanned antenna.

Another object of the invention is to provide an electronically scanned system for applications in which high beam scan rates or non-linear scan functions are required.

Still another object of the invention is to provide an electronically scanned antenna system which provides a much simpler and more economical means of achieving electronic scanning by reducing the number of phase shifters utilized in prior art phase shift scanning systems.

Still another object of this invention is to provide an electronic scanning system which substantially eliminates step scanning to provide smooth continuous beam steering.

Still yet another object of the invention is to provide an electronic scanning system which provides a wide scan sector capability of up to about 130° without radiation pattern parameters, such as gain, beam width and sidelobe levels degrading at the scan limits.

Briefly stated, the invention comprises an amplitude modulating scanning antenna system for electronic scanning by amplitude modulating an RF signal in a plurality of feed elements with attenuators, and commutating the RF signal along the feed element array with switches. A digital controller provides the control signals for the attenuator and switches and provides encoder output signals and fault signals. In effect, a set of beams is formed selectively spaced apart which are turned on and off smoothly in a time sequenced manner. Each beam illuminates a different sector of an antenna reflector.

These and other objects and features of the invention will become more readily understood in the following detailed description taken in conjunction with the drawings in which.

Figure 1:
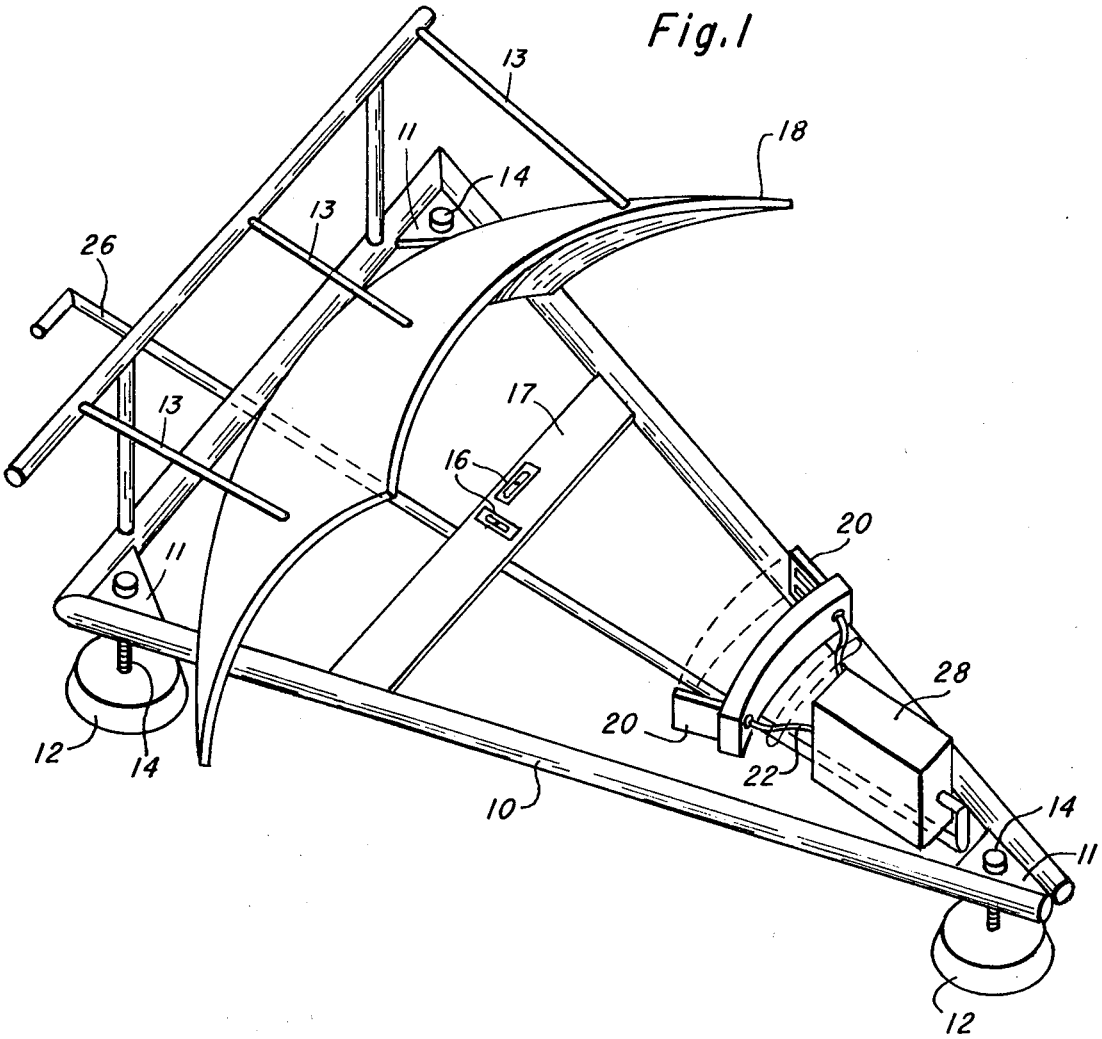
FIG. 1 is an isometric view of the amplitude modulation scanning antenna system.

Referring to the drawings, the amplitude modulated scanning antenna system construction of the embodiment of the invention comprises an antenna supporting frame 10 mounted upon support piers 12. Level adjustment screws 14 interconnect the antenna supporting frame to the support piers and vertical and horizontal levels 16 are mounted on the antenna supporting frame to indicate when the frame has been made level through manipulation of the level adjustment screws 14. An antenna reflector 18 is attached to the antenna supporting frame in front of a feed element array 20. RF coaxial cables 22 connect the feed element array to the scan control unit 28. Waveguide 26 conducts RF energy from a source not shown to the scan control unit 28 which controls the distribution of the RF energy.

The antenna supporting frame 10 may comprise, for example, a tubular frame having a triangular configured base portion with corners reinforced with gusset plates 11 and an upright portion substantially normal to the base portion. The gussett plates 11 are adapted to receive level adjustment screws 14 threadedly engaging elongated cylindrical cups mounted in the support piers 12. The support piers 12 may be, for example, constructed of concrete for ground installation. The vertical and horizontal levels 16 are mounted on a crossmember 17 of the tubular frame 10. Thus, the frame may be leveled on the support piers 12 by adjusting the screws 14 of the level adjustment means. The base member of the triangular frame member supports the upright portion of the support frame 10 normal to the triangular portion, and the reflector is attached to the base member and to a plurality of reflector connecting rods 13 connected to the upright portion of the frame.

The reflector 18 has a spoiled parabolic contour in the vertical dimension and has a circular contour in the horizontal dimension. The elevation contour is selected to give the required elevational pattern shape. The two dimensional reflector contour is formed, for example, by a 70 inch radius through about 100° of circular arc. The reflector 18 is a fiberglass honeycomb sandwich with a metal screen (not shown) embedded in the front surface.

The feed element array, for example, comprises 16 feed elements such as, for example, horns, dipoles, multi-element Yagi array, or the like located along a 37 inch radius circular arc concentric with the reflector and spaced 2° apart. Preferably each element is an endfire array with three dipoles fed by two wire transmission lines; the elements are fabricated by etching on microwave printed board. A radome is used to protect the feed assembly.

Figure 2:
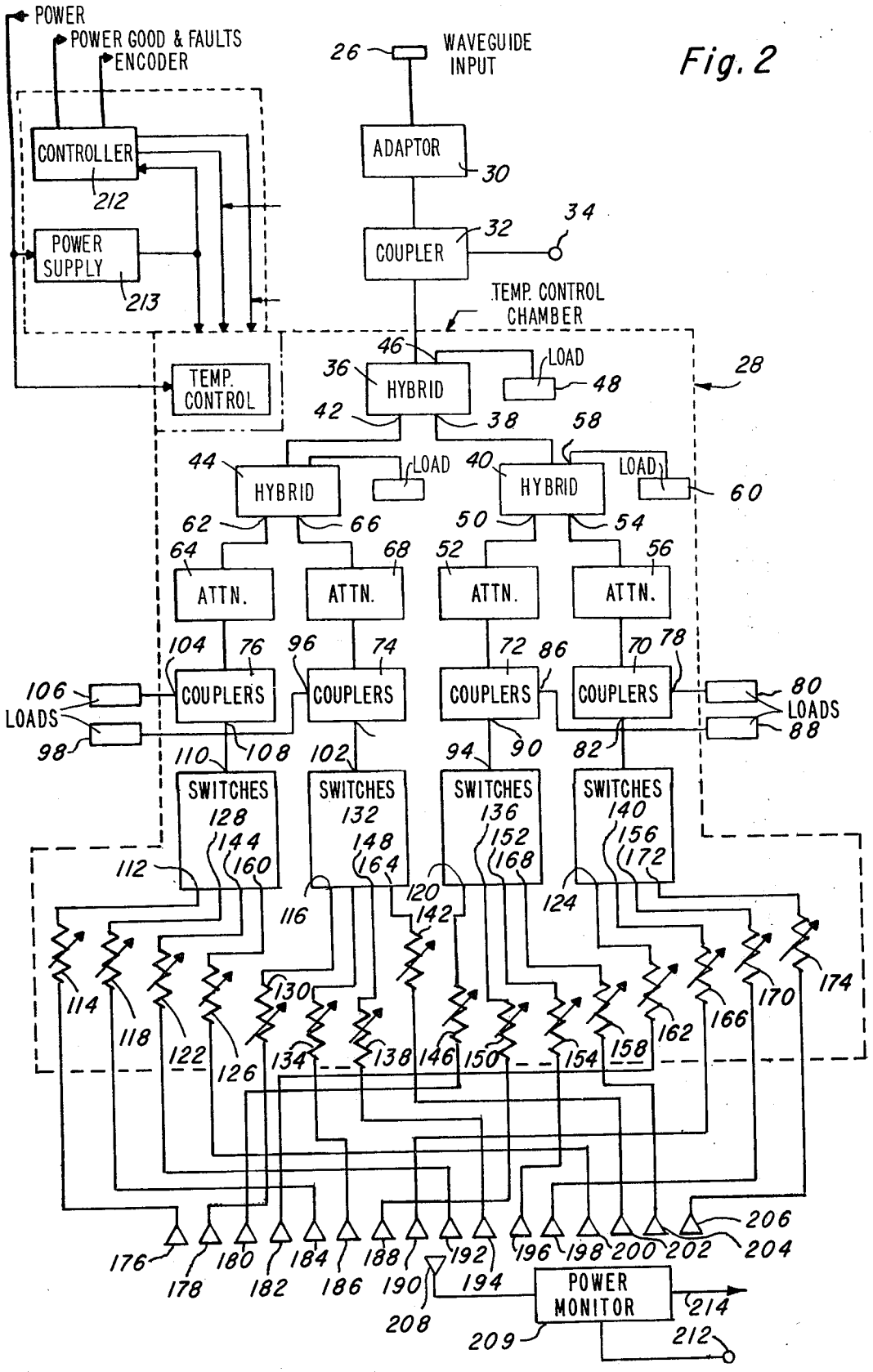
FIG. 2 is a schematic diagram of the scan control unit of the amplitude modulation scanning antenna system.

The scan control unit 28 for the amplitude modulated scanning (AMSCAN) system receives RF energy for transmission. The RF transmit signal is initially split into four equal amplitude signals and fed to four attenuators such as PIN attenuators, by power dividers. Directional couplers are provided to allow power and RF spectrum testing while the system is operating. Switches send the RF signals to four adjacent feed elements and commutate the signals across the 16 element array. Mechanical amplitude trim attenuators are used to equalize the insertion loss of the 16 paths and the phases of the 16 paths is equalized by adjusting the coax cable lengths between the switches and the feed elements. More specifically, RF energy is fed to the system through waveguide 26 (FIGS. 1 and 2) to an adapter network 30 (FIG. 2). The adapter may be, for example, a NARDA 613A waveguide to coax adapter for changing the $TE_{01}$ mode of the field of the waveguide to the coax mode. A coupler 32 interconnects the adapter to a first hybrid tee 36 and provides a test port 34 for power and phase measurements. A suitable coupler may be a 6 db NARDA 4014C - 30 coupler. The hybrid tee 36 may be, for example, a NARDA 4034C (90°) power divider. Ports 38 and 42 of the first hybrid tee 36 are coupled, respectively, to second and third hybrid tees 40 and 44, whilst the remaining port 46 is coupled to a load 48 for power dissipation. Hybrid tee 40 has ports 50 and 54 coupled to attenuators 52 and 56, respectively, whilst port 58 is connected to a power dissipating load 60. The third hybrid 44 has ports 62 and 66 connected, respectively, to attenuators 64 and 68, whilst the remaining port is connected to a power dissipating load. Hybrids 40 and 44, like hybrid circuit 36, may be, for example, NARDA 4034C hybrid circuits.

Attenuators 52, 56, 64 and 68 each receive carrier control signals from controller 212 and reduce the strength of the RF energy to a desired adjustable amount without introducing appreciable distortion in the signals. Suitable attenuators are SK-MD-42C15D Micro-Dynamics Incorporated attenuators. The amplitude modulated outputs of the attenuators 52, 56, 64, and 68 are fed, respectively, to couplers 72, 70, 76, and 74. The couplers 70–76 are, for example, NARDA 4014C-20 (20 db) couplers. Couplers 70, 72, 74, and 76 have ports 78, 86, 96, and 104 coupled, respectively, to test ports 80, 88, 98, and 106; and ports 82, 90, 100, and 108 coupled to switches 84, 94, 102, and 110, respectively. Switches 84, 94, 102, and 110 are four pole switches controlled by switch control signals generated by controller 212, hereinafter described. The switch 110 has its poles 112, 128, 144, and 160 coupled, respectively, to trim attenuators 114, 118, 122, and 126. Switches 102, 94, and 84 are identical to switch 110, all of which may be, for example, SK-MD-15C-37D MDI switches. Switches 102, 94, and 84 have their poles 116, 132, 148 and 164; 120, 136, 152 and 168; and 124, 140, 156 and 172 coupled, respectively, to mechanical trim attenuators 130, 134, 138, and 142; 146, 150, 154, and 158; and 162, 166, 170 and 174. The 16 trim attenuators may be, for example, AUM-15A Merrimac attenuators. The 16 trim attenuators are connected through coaxial cables having their lengths adjusted to equalize the phase of the 16 paths to the feed elements as follows: attenuators 114, 130, 146, and 162 are coupled, respectively, to feed elements 176, 178, 180 and 182. Trim attenuators 118, 134, 150 and 166 are coupled to feed elements 184, 186, 188 and 190. Trim attenuators 122, 138, 154, and 170 are coupled, respectively, to feed elements 192, 194, 196, and 198. Trim attenuators 126, 142, 158 and 174 are coupled, respectively to feed elements 200, 202, 204, and 206.

A monitor probe 208 is coupled to a power monitor 209. The power monitor is connected to controller 212 terminal and is operative responsive to the control signals from the controller 212 to monitor each of the 16 feed elements. The power monitor signals an alarm 214 should any of the 16 feed elements be inoperative. Necessary power is supplied the controller 212 and systems by the power source 213.

Figure 3:
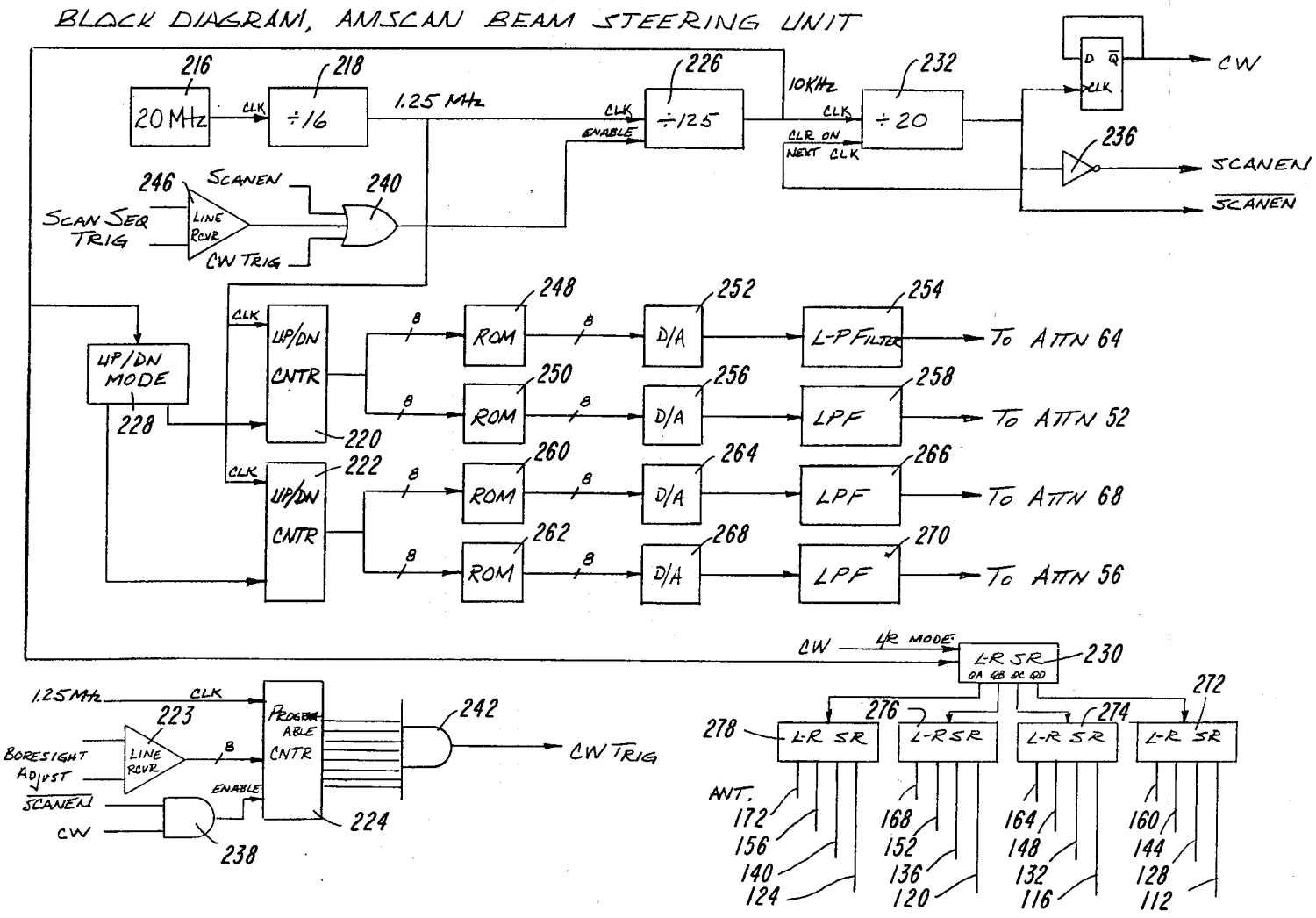
FIG. 3 is a schematic diagram of the controller for the scan beam steering unit.

The controller 212 may be that shown in FIG. 3 and comprises a clocking oscillator 216 (FIG. 3) operating, for example, at frequency of 20 MHz. Clocking oscillator 216 is coupled to divide circuit 218 which may be, for example, a divide by 16 circuit to provide a 1.25 MHz signal to: a second divide circuit 226, up/down counters 220 and 222 and programable counter 224. The second divide circuit may be, for example, a divide by 125. The divide by 125 circuit 226 also receives an enable pulse from a feedback circuit hereinafter described. The divide by 125 circuit 226 is coupled to an up/down mode selector circuit 228, a left/right shift register 230, and a counter 232 which may be, for example, a count by 20 circuit. Upon receipt of an enable signal, the divide by 125 circuit 226 provides a 10 KHz signal to the up/down mode selector 228, left/-right shift register 230 and count by 20 circuit 232. The count by 20 circuit is coupled to flip flop clock circuit 234, an inverter 236, an input terminal of the count by 20 circuit 232, and to a terminal of an AND gate 238. The count by 20 circuit provides for counterclockwise scanning, a low voltage for 0–19 counts and a high voltage for the 20th count to: the flip flop clock circuit 234 to switch to a clockwise scanning mode; inverter 236; input terminal of a count by 20 circuit 232 to clear the count by 20 circuit on receipt of the next clocking pulse; and an input terminal of AND gate 238.

The clocking flip flop 234 has its D terminal output coupled to $\overline{Q}$ output terminal to provide a clockwise scanning (high) signal to the second input terminal of AND gate 238 and to an input for the left/right mode of the left/right (counterclockwise/clockwise) shift register 230. The inverter 236 is coupled to OR gate 240 and when its ouput is high provides an enable pulse to divide by 125 circuit 226. AND gate 224 is coupled to the programmable counter 238 and when activated by high outputs from clocking flip flop 234 and count by 20 circuit 232 provides an enable pulse to the programmable counter 224. The programmable counter 224 also receives in addition to the 1.25 MHz signal a boresight adjustment signal applied through a line receiver amplifier 223. The boresight adjust signal is produced by a switch (not shown) which is manually manipulated to align the clockwise trigger pulse with a suitable reference such as, for example, the center line of an air port runway. After boresight, the programmable counter 224 provides 8 selected counting increments to an 8 input AND gate 242. When the AND gate goes high, a clockwise trigger pulse is applied to one terminal of an OR gate 240 and a clockwise scan enabling pulse is sent to the divide by 125 circuit 226.

If desirable, a scan sequence trigger, from a source not shown, can be applied through line receiver amplifier 246 to another input terminal of OR gate 240. The scan sequence trigger originates from a master counter which, for example, may be located in a shelter remote to the AMSCAN system which coordinates the AMSCAN system operation with other systems such as, for example, an airport surveillance radar system and provides the initial start up trigger pulse for counterclockwise scanning of the AMSCAN system.

The up/down mode circuit 228, as previously mentioned, receives the 10 KHz signal from the divide by 125 circuit 226 and applies the 10 KHz signal to counters 220 and 222 90° or 125 counts out of phase. The up/down counters 220 and 222 also, as previously stated, receive the 1.25 MHz signal from the divide by 16 counter 218 and produce 250 address sequences for each clockwise and counterclockwise scan. The address sequences of counter 220, which may be, for example 8 bit words, are applied to ROMS 248 and 250 and the address sequences of counter 222 are applied to ROMS 260 and 262. ROM 248 is at 0° phase shift and ROM 250 is the reverse or 180° out of phase. Whilst, ROM 260 is 90° out of phase as to ROM 248 and ROM 262 is 270° out of phase as to ROM 248. ROM's 248, 250, 260, and 262 provide 500 digital signals comprising 8 bit voltage words for voltages between 0–10 v and 10–0 v to digital-to-analog converters 252, 256, 264, and 268, respectively. The analog voltage signals of digital-to-analog converters 252, 256, 264, and 268 are passed, if necessary for a smooth sine wave output, through low pass filters 254, 258, 266, and 270, respectively, and the resulting smooth sine wave signals are applied to attenuators 64, 52, 68, and 56 (FIG. 2), respectively for modulating the RF energy received from the hybrid circuits 44 and 40.

As previously stated the outputs of the divide by 125 circuit 226 (FIG. 3), and clock 234 are connected to the left/right shift register 230. The left/right shift register 230 has four outputs, $Q_a$, $Q_b$, $Q_c$, and $Q_d$ connected, respectively, to left/right shift registers 272, 274, 276, and 278. The outputs of shift registers 272, 274, 276 and 278 control, respectively, the poles of switches 110, 102, 94, and 84, i.e., the $Q_a - Q_d$ outlets are sequentially opened for 500 counts each in synchronism with the 500 voltage outputs of low pass filters 254, 258, 266, and 270 applied to attentuators 64, 52, 68, and 56.

As the individual circuits and components thereof involved in the controller 212 are all in existence and within the knowledge of those skilled in the art, schematic diagrams of the circuits therefor are not included.

In operation of the controller 212, a scan sequence trigger pulse is received from a system control switch, not shown, to start the AMSCAN system cycle. The scan sequence trigger is generated on a time sharing basis to permit operation of other transmitting systems without interference. The scan sequence trigger is coupled through the line receiver amplifier 246 to turn on OR gate 240. The OR gate circuit applies a logic 1 (high) signal to enable the divide by 125 circuit 226 which provides a 10 KHz signal to the up/down mode circuit 228, the left/right shift register 230, and count by 20 circuit 232. The count by 20 circuit 232 counts 1 through 19 10KHz pulses to provide a logic 0 (low) signal to: inverter 236 which provides a logic 1 (high) signal to OR gate 240 to maintain the enable signal on the divide by 125 circuit 226; flip-flop 234 for timing the counter clockwise scanning of the antenna and setting the mode of the left/right shift register 230 to the counter-clockwise (left) mode; and providing a logic 0 (low) signal to AND gate 238 to keep it off. The count by 20 circuit 232 on count 20 produces a logic 1 (high) signal to: inverter 236 which goes low to cut off OR gate 240 to inactivate the divide by 125 circuit 232 and stop the 10 KHz signal to the up/down mode circuit 228 and left/right shift register 230; count by 20 circuit 232 to provide a pulse in waiting to reset on the next pulse the count by 20 circuit to 0 for the next scan cycle; and flip-flop 234 to switch it to a logic 1 (high) signal to provide a logic 1 (high) signal to AND gate 238.

The AND gate circuit 238 upon receipt of the logic 1 (high) signals from the flip-flop 234 and count by 20 circuit 232 goes high to enable the programmable counter 224. The programmable counter 224 during a preselected count supplies high signals to an 8 input AND gate 242 whose output goes high (logic 1) to turn on OR gate 240 for a clockwise scan. The OR gate circuit output enables the divide by 125 circuit 226 to re-establish the 10 KHz signal to the up/down mode circuit 228, the left/right shift register 230, and the count by 20 circuit 232 which upon activation is reset to 0 by the above-mentioned pulse in waiting. During the clockwise scan (0 through 19 counts), the count by 20 circuit 232 provides a low (0) signal: to flip-flop 234, inverter 236, count by 20 circuit 232 and AND gate 238. During this clockwise count: the flip-flop 234 provides a high (1) output which changes the mode of the L-R shift register 230 to the clockwise (Right) mode. The inverter circuit 236 applies a high (1) signal to the OR gate to maintain the enabling pulse on the divide by 125 circuit 226. During the twentieth count, the output of the count by 20 circuit goes high (1) and this high signal is applied: to flip-flop 234, to the count by 20 circuit to provide a pulse in waiting to reset the count by 20 circuit 232 on receipt of the next pulse, and through inverter 236 to apply a low voltage to the OR gate 240 to turn the system off. The system is off until another scan sequence trigger pulse is received.

During the counterclockwise and clockwise scan, the up/down mode circuit 228 provides a zero counting phase lag signal to up/down counter 220 and a 90° counting phase lag signal to up/down counter 222. The up/down counter 220 provides 8 bit address words to read only memories (ROMs) 248 and 250. The counting phase lag of ROM 250 is 180° out of phase as to ROM 248. The up/down counter 222 provides 8 bit address words to ROMs 260 and 262. The counting phase lag of ROM 260 is 90° out of phase as to ROM 248 and ROM 262 is 270° out of phase as to ROM 248. The ROMs 248, 250, 260 and 262 contain attenuation function information, i.e., attenuation versus time. For example, the ROMs contain 250 up and 250 down voltage steps between 0 and 10 volts.

Responsive to the up/down address signals, the ROM's apply 250 eight bit voltage words for each 2° of scan to digital to analog converters 252, 256, 264 and 268. Thus, ROM 248 activates D/A converter 252 at 0° count phase lag, ROM 260 activates D/A converter 264 at 90° count phase lag, ROM 250 activates D/A converter 256 at 180° count phase lag, and ROM 262 activates D/A converter 268 at 270° count phase lag to produce voltage amplitude signals from, for example, 0 to 10 volts and back to 0 volts 90° out of phase and in a timed sequence through low pass filters 254, 266, 258, and 270, respectively, to attenuators 64, 68, 52, and 56, respectively. The low pass filters are to remove substantially the ripple from the signals. With a sufficient number of voltage steps, it has been found that the filtering inherent in the D/A converters provides a sufficiently smooth voltage curve, in which case the low-pass filters may be eliminated.

Figure 4:
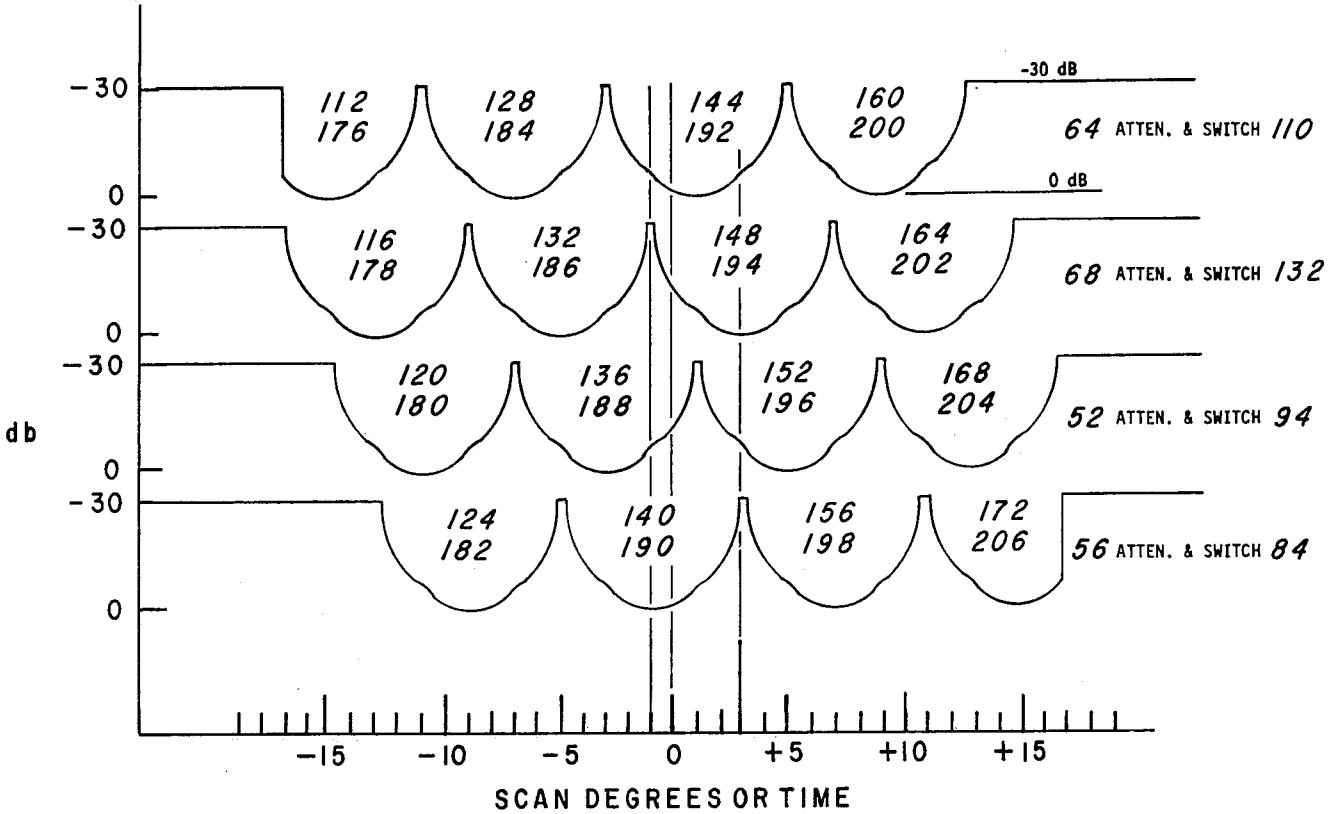
FIG. 4 is a graphic presentation of the amplitude modulated signals produced by the attenuators and transmitted by time sequencing the switches.

With the controller 212 operating as described, the outputs of attenuators 64, 52, 68, and 56, respectively, are controlled by the switch poles of switches 110, 94, 102, and 84, respectively, to produce modulated signals at the feed elements 176 – 206 as shown in FIG. 4.

As shown in FIG. 4, the switch pole number is placed over the feed element number it controls in the decibel (db) plot for each feed element. The applicable switch numbers and attenuator numbers are shown on the right side, the db on the left side and the scan degrees on the abscissa. The switch poles 112, 128, 144, and 160 of switch 110 are sequentially controlled by left/-right shift register 272 (FIG. 3); shift registers 274, 276, and 278 control, respectively, switch poles 116, 132, 148, and 164 of switch 102; switch poles 120, 136, 152, and 168 of switch 94; and switch poles 124, 140, 156, and 172 of switch 84. Thus as shown in FIG. 4, for a counter clockwise (left) scan, switch pole 112 of switch 110 is turned on first; next, after 90° count phase lag, switch pole 116 of switch 102 is turned on; next, after 180° count phase lag, switch pole 120 of switch 94 is turned on; and next, after 270° count phase lag, switch pole 124 of switch 84 is turned on. After 360° count phase lag, switch pole 112 of switch 110 is turned off to complete the plot of feed element 176, and pole switch 128 of switch 110 is turned on to start the plot of feed element 128. This cycle continues on across the switches to produce the feed element patterns shown, respectively, for feed elements 176 – 206. The following table I shows, for a counter clockwise scan, the sequence of cycling:

TABLE I

| Cycle | SWITCH POSITION | FEED ELEMENT ON |
|---|---|---|
| 1 | 112 | 176 |
| 2 | 112, 116 | 176, 178 |
| 3 | 112, 116, 120 | 176, 178, 180 |
| 4 | 112, 116, 120, 124 | 178, 180, 182, 184 |
| 5 | 116, 120, 124, 128 | 178, 180, 182, 184 |
| 6 | 120, 124, 128, 132 | 180, 182, 184, 186 |
| 7 | 124, 128, 132, 136 | 182, 184, 186, 188 |
| 8 | 128, 132, 136, 140 | 184, 186, 188, 190 |
| 9 | 132, 136, 140, 144 | 186, 188, 190, 192 |
| 10 | 136, 140, 144, 148 | 188, 190, 192, 194 |
| 11 | 140, 144, 148, 152 | 190, 192, 194, 196 |
| 12 | 144, 148, 152, 156 | 192, 194, 196, 198 |
| 13 | 148, 152, 156, 160 | 194, 196, 198, 200 |
| 14 | 152, 156, 160, 164 | 196, 198, 200, 202 |
| 15 | 156, 160, 164, 168 | 198, 200, 202, 204 |
| 16 | 160, 164, 168, 172 | 200, 202, 204, 206 |
| 17 | 164, 168, 172 | 202, 204, 206 |
| 18 | 168, 172, | 204, 206 |
| 19 | 172, | 206 |

Zero degree scan is the reference point selected and as shown, for example, represents the centerline azimuth of an airport runway. The zero degree azimuth scan may fall between feed elements 190 and 192 at which point element 190 is about 1 db past zero db attenuation or 180° mark and element 192 and 1 db before the zero db attenuation. The other two on elements 188 and 194 are, respectively about 9 db past and before the zero db attenuation points. At −1° scan, element 190 is at zero db attenuation, element 188 is about 3 db down past zero attenuation, element 194 is about 30 db down, and element 192 is about 3 db down before zero db attenuation; whilst at +3° scan, element 190 is attenuated about 30 db down past zero db attenuation, element 196 about 9 db down before zero db attenuation, element 194 about zero db attenuation, and element 192 about 9 db down past zero attenuation.

Figure 5:
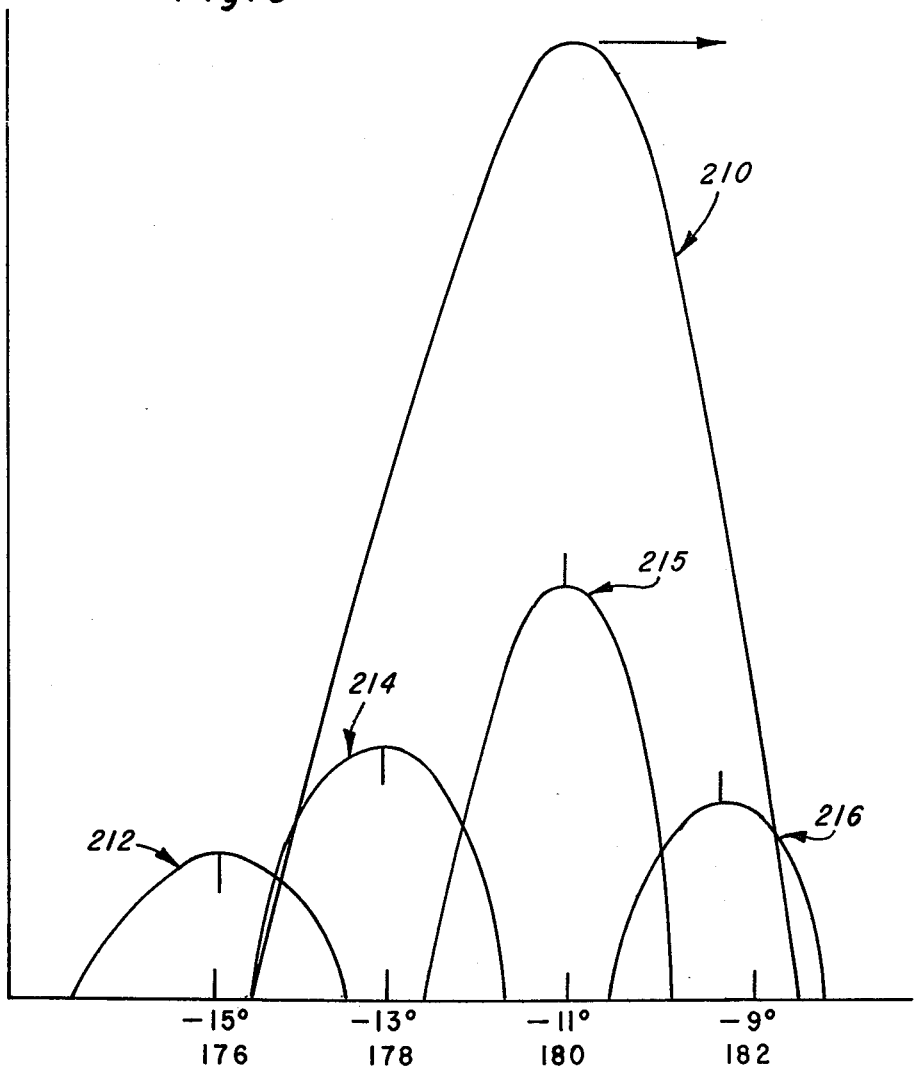
FIG. 5 is a graphic presentation of the forming of the scanning beams.

The AMSCAN antenna beam patterns for any four feed elements actuated such as, for example, feed elements 176, 178, 180 and 182 is shown in FIG. 5. As shown the beam 210 is the summation of the outputs of the feed elements 176, 178, 180, and 182 near the −11° scan (FIG. 4). At this point in time, beam 212 is the falling output of the element seen at −15° azimuth and comprises essentially the energy of element 176 whose peak is low; beam 214 is the falling output of the element 178 at −13° azimuth, beam 215 is the rising output of the element 180 at −11° azimuth; and beam 216 is the rising output of the element 182 at −9° azimuth. From FIG. 5, one can visualize that, as two beams at adjacent lower azimuth positions are of different amplitudes below that of a rising third beam with a fourth rising beam of lower amplitude at a higher azimuth position, the resulting beam resembles an ocean swell with its peak sweeping continuously at a substantially constant amplitude from left to right.

Although a single embodiment of the invention has been described herein, it will be apparent to a person skilled in the art that various modifications to the details of construction shown and described may be made, such as, for example, the drive circuits of controller 212 for attenuator control and the switches can be combined to reduce substantially the circuitry of controller 212, without departing from the scope of this invention.

What is claimed is:

1. An amplitude modulated scanning system comprising:

a. a source of RF energy;

b. a plurality of power dividers coupled to the source of RF energy for dividing the RF energy for the output terminals of the plurality of power dividers;

c. a plurality of electronic attenuators coupled to the outputs of the plurality of power dividers for receiving the RF energy;

d. a plurality of switches coupled to the electronic attenuators;

e. a plurality of feed elements coupled to the outputs of the plurality of switches;

f. a reflector mounted in front of said plurality of feed elements;

g. a controller, said controller operatively coupled to said plurality of attenuators and switches for selectively attenuating the plurality of attenuators for amplitude modulating the RF energy received from the power dividers, and selectively opening the switches to feed the amplitude modulated RF energy to selected feed elements for forming a cluster of overlapping beams filling a desired angular scan sector whereby said individual beams of the cluster of overlapping beams continuously rise and fall sequentially to provide a continuous beam sweeping across the reflector; and h. a support for supporting the feed elements and reflector, said supports supporting the feed elements in a selected spaced relationship to the reflector.

2. An amplitude modulated scanning system according to claim 1 further including a plurality of trim attenuators coupled between the RF energy source and the feed elements for adjusting any feed element amplitude errors.

3. An amplitude modulated scanning system according to claim 1, further including a plurality of trim phase shifters coupled between the RF energy source and the feed elements for adjusting any feed element phase errors.

4. An AMSCAN system according to claim 1 wherein said plurality of power dividers for dividing power from a source of RF energy to the plurality of attenuators are hybrid circuits.

5. An AMSCAN system according to claim 4, wherein said hybrid circuits comprise a first hybrid circuit coupled to a source of RF energy, and second and third hybrid circuits coupled to the output of the first hybrid circuit to divide the RF energy amongst the plurality of electronic attenuators.

6. An AMSCAN system according to claim 5, wherein the plurality of electronic attenuators at least four attenuators coupled to the outputs of the second and third hybrids for attenuating the RF energy for the plurality of feed elements.

7. An AMSCAN system according to claim 1, wherein the plurality of feed elements coupled to the plurality of attenuators comprise at least 4 selectively spaced feed elements.

8. An AMSCAN system according to claim 1, wherein the controller comprises a means for producing a preselected frequency; selected divide circuits for dividing the preselected frequency of the frequency producing means; an amplitude modulating signal producing means selectively coupled to the divide circuits for selectively applying amplitude modulating signals of varying amplitude to the plurality of electronic attenuators; and a switch selector means coupled to the selected divide circuits for selectively opening the plurality of feed element control switches.

9. An AMSCAN system according to claim 8, wherein the amplitude modulating signal producing means comprises: address means coupled to the frequency dividing circuits; a plurality of memory means coupled to the address means and containing amplitude modulating information; a plurality of digital to analog converters producing amplitude modulating signals for the PIN attenuators.

10. An AMSCAN system according to claim 9, further including a plurality of filters for smoothing the ripple in the amplitude modulating signals.

11. An AMSCAN system according to claim 9, wherein the address means comprises an up/down mode circuit coupled to the circuit divide means, and a plurality of up/down counters coupled to the up/down mode circuit and responsive thereto for providing addresses to the plurality of memories for producing amplitude modulating signals for the plurality of electronic attenuators.

12. An AMSCAN system according to claim 8, wherein the switch selector means comprises a plurality of shift registers.

13. An AMSCAN system according to claim 12, wherein the plurality of shift registers control the feed element control switches to produce counterclockwise and clockwise moving scanning beams.

* * * * *